US005259281A

United States Patent [19]

Burke

[11] Patent Number: 5,259,281

[45] Date of Patent: Nov. 9, 1993

[54] COMBINATION HAND TOOL

[76] Inventor: Donald D. Burke, 9719 N. Flora, Kansas City, Mo. 64155

[21] Appl. No.: 4,787

[22] Filed: Jan. 14, 1993

Related U.S. Application Data

[63] Continuation-in-part of Ser. No. 766,744, Sep. 27, 1991, abandoned.

[51] Int. Cl.[5] ..... B25F 1/00

[52] U.S. Cl. ..... 81/437; 81/124.4; 81/124.3; 81/120; 7/138; 7/165

[58] Field of Search ..... 7/138, 165, 166; 81/119, 121.1, 124.3, 124.4, 125, 186, 437, 120, 3.4

[56] References Cited

U.S. PATENT DOCUMENTS

| | | | |
|---|---|---|---|
| 167,368 | 8/1875 | Waitt . | |
| 171,353 | 12/1875 | Conway . | |
| 242,130 | 5/1881 | Hurlbut . | |
| 280,793 | 7/1883 | Case . | |
| 502,525 | 8/1893 | Menehan | 81/437 X |
| 661,011 | 10/1900 | Converse | 81/119 X |
| 2,148,573 | 2/1939 | Mulcay | 81/437 X |

FOREIGN PATENT DOCUMENTS

| | | | |
|---|---|---|---|
| 968485 | 4/1950 | France | 81/124.3 |

*Primary Examiner*—James G. Smith

[57] ABSTRACT

A hand tool is provided having opposing jaws with teeth and depressions mounted on one of said jaws to enable torque to be applied to a variety of sizes of fasteners. A wedge portion and a hexagonal hole portion of the tool provide added functions of a screw driver and pry bar and grip for a hexagonal socket.

5 Claims, 2 Drawing Sheets

Fig. 1
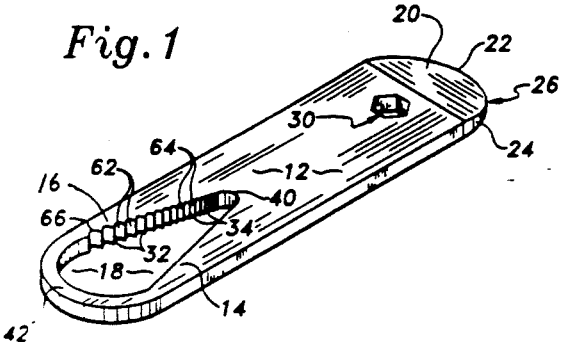
Fig. 2
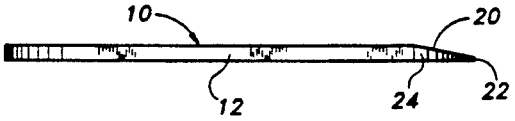
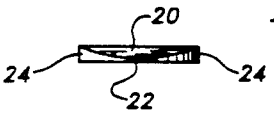
Fig. 3
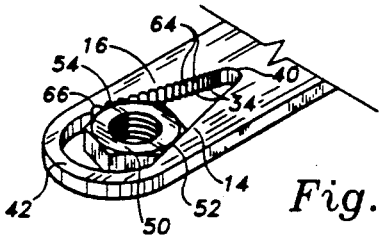
Fig. 4
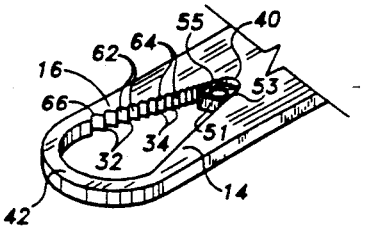
Fig. 5
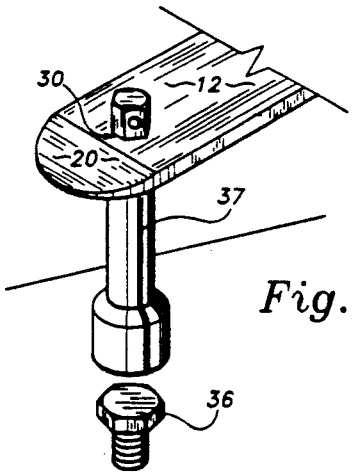
Fig. 6
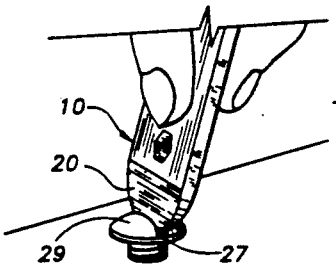
Fig. 7

COMBINATION HAND TOOL

CROSS REFERENCE

This is a continuation-in-part of Ser. No. 07/766,744, filed Sept. 27, 1991, now abandoned.

Reference is made to Design patent application Ser. No. 07/590,284, Filed: Sept. 28, 1990, titled POCKET-WRENCH which is directed to subject matter related to that of the present application.

BACKGROUND OF THE INVENTION

In the course of work or recreation it is frequently necessary to apply torque to a fastener or to wedge open a closure or to tighten a screw. Frequently the proper tool for such a procedure is not at hand and one must rely upon the nearest kitchen implement or whatever materials are within the grasp of the individual. This reliance on the flotsam and jetsam of life to perform the application of torque or twisting or to provide resistance to torque or twisting frequently leads to use of an improperly sized or inadequate device. This, in turn, often results in damage to the mechanical structure being worked upon or injury to the individual due to slippage or breakage of an inadequate tool. Typically, this type of activity is performed when the individual is in a rush to accomplish the task or the workpiece is in an inconvenient location and acquiring the proper tool would necessitate perceived inconvenience and additional time spent by the individual. Such situations commonly occur in dealing with tasks which are spontaneously generated during the course of activity in daily life as opposed to planned repair activities where the proper tools for the job have been previously contemplated and acquired.

Thus, the penny or dime which is handily found in the pocket commonly becomes a screw driver or pry bar and the key chain or two keys in parallel array are used for applying torque or resisting torque. Such reliance upon makeshift tools is inadequate for the job and damaging to the workpiece, the makeshift tool and, potentially, the individual.

It is generally not possible for the average individual to carry a convenient set of tools. Nor are most specialty tools which can be conveniently carried in the pocket of sufficient size and strength to accomplish the variety of tasks demanded of them. There is an inherent danger in carrying a screw driver in the pocket as it may be jammed into the body when the individual bumps against a solid object. In addition, the size of the screw driver initially must be selected and thus will be inadequate for screws which are larger or screws which are smaller than the particular size selected. In the case of a wrench, it is not possible to carry a selection of wrenches. However, this problem could be avoided by carrying an adjustable jaw type wrench. Unfortunately, the design of the adjustable jaw type wrench necessitates a certain degree of bulk making it less than convenient as a tool and also limiting the spaces into which it may be applied for use. Further, such a pocket sized adjustable jaw type wrench would not be useful as a pry bar or as a screw driver.

Another object of the present invention is to provide a compact wrench type tool capable of delivering or resisting high torque loads on the order of what might typically be supplied by wrist force of the user, and to do this without slipping on the fastener or damaging itself.

It is another object of the present invention to provide a very lightweight multipurpose tool and wrench for use in applications where tool lightens is important, i.e., aircraft flight kits, camping, climbing, bicycling, etc.

It is another object of the present invention to provide a compact gripping tool that can be used in many applications where a small pair of pliers may not be used easily due to the requirement of a squeezing force in order to grip the fastener. This is a common problem in confined, hard to reach, and out of sight areas of mechanical work.

It is another object of the present invention to provide a multipurpose tool and wrench that can be carried casually on the person as a pen knife or pocket comb such that the carrier can be comfortably unaware of its presence when not needed.

Therefore, it is an object of the present invention to provide a multipurpose tool which may be conveniently carried in the pocket of a user and thus quickly and conveniently brought to bear on work situations.

It is another object of the present invention to provide a wrench type tool which may be conveniently carried.

Yet another object of the present invention is to provide a wrench type tool capable of gripping a range of fasteners.

Another object of the present invention is to provide a wrench type tool capable of use on both standard and metric type fasteners.

It is yet another object of the present invention to provide a tool capable of gripping square or hex type fasteners or wing-nut type fasteners or other variously shaped fasteners which can be fitted into the opening.

Yet another object of the present invention is to provide a conveniently carried straight blade screw driver capable of use with a wide variety of sizes of slotted screws or bolts.

Another object of the present invention is to provide a tool of great strength and resilience so as to be able to apply a high degree of torque or resistance to torque to an object.

Another object of the present invention is to provide a tool which may be used as a pry bar for the opening of wedged closed objects.

Yet another object of the present invention is to provide a handle for holding and turning square or hexagonally shaped instruments.

Yet another object of the present invention is to provide a wrench type tool which is rapidly and conveniently adjustable to a wide variety of fasteners without removing the tool from capture of the fastener to permit adjustment.

These and other objects of the invention will be illustrated by the drawings provided herein in conjunction with the description of the preferred embodiment.

DESCRIPTION OF THE DRAWINGS

FIG. 1 is a top front right side perspective view of the tool showing the opening for capture of a workpiece and the hexagonal opening for capture of a hexagonally shaped socket set piece;

FIG. 2 a right side elevational view of the tool showing the bevelled end for use as a pry bar or screw driver;

FIG. 3 is an end elevational view of the bevelled end of FIG. 2 and showing the variation in thickness of the bevel;

FIG. 4 is a fragmentary view of FIG. 1 showing the capture of a fastener within the opening with one face of the fastener wedged against one sidewall of the opening and an opposite corner of the fastener engaged within the teeth of the opposite sidewall of the opening;

FIG. 5 illustrates the capture within the opening of the tool of a small fastener;

FIG. 6 illustrates the use of the hexagonal opening to capture an implement from a socket seat with the tool acting as a handle therefor; and FIG. 7 illustrates the use of the bevelled edge of the tool as a screw driver for applying torque to a screw or threaded bolt.

LIST OF DRAWING REFERENCE NUMERALS

Figure 8:
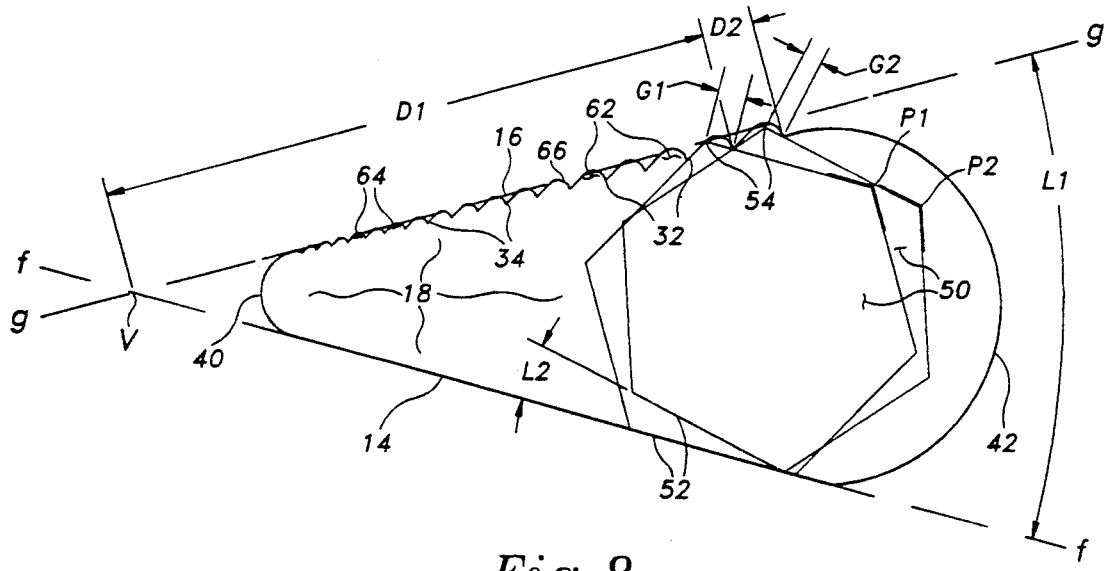
FIG. 8 is a schematic diagram showing a bottom side plane view of the wrench opening geometry and the relationship between the opening components themselves and two positions of a hexagonal fastener.

10 Combination Tool
12 Body
14 Sidewall
16 Sidewall
18 Opening
20 Bevelled End
22 Bevelled End Tip
24 Area of thickness change from body to bevelled end
26 Bevelled Edge
27 Slot
29 Screw or Bolt Head
30 Hexagonal Opening
32 Tooth Projections
34 Tooth Projections
37 Socket Tool
40 Narrow End of Opening
42 Wide End of Opening
50 Large Fastener
51 Small Fastener
52 Large Fastener Flat Face
53 Small Fastener Flat Face
54 Angled Corner of Large Fastener
55 Angles Corner of Small Fastener
62 Depressions Between Tooth Projections
64 Depressions Between Tooth Projections
66 Full Inside Radius between Tooth Projections
D1 Tooth Distance from Sidewall Geometric Vertex
D2 Tooth Pitch
G1 Grip Area of Large Fastener 50 in Position One
G2 Grip Area of Large Fastener 50 in Position Two
L1 Angle between Sidewalls
L2 Angle of Deflection
L3 Angle between Sidewall 14 and Flat Face 52 of Large Fastener 50
ff Reference Line through Center of Tooth Form of Sidewall 16
gg Reference Line of Sidewall 16
V Vertex of Reference Line ff and Reference Line gg
P1 Large Fastener 50 in Position One
P2 Large Fastener 50 in Position Two

DESCRIPTION OF THE PREFERRED EMBODIMENT

Referring not to FIG. 1 the major components of the combination tool 10 may be observed. The body 12 of the tool is comprised of high carbon steel or high carbon stainless steel. It is hardened and tempered to a final hardness of 50 or above on the Rockwell C scale. The ends of body 12 are fully radiused to provide maximum bluntness, which allows greater hand force to be applied without discomfort. The body 12 has smooth finished surfaces and edges so as to facilitate comfort in the and and to avoid snagging clothing or other objects when not in use, in the pocket, or elsewhere on the person. The selection of a high quality steel is desirable so that substantial torque may be applied to a fastener by the tool without resulting in deformation of the sidewalls 14, 16 of opening 18 or deformation of the teeth 32, 24 on sidewall 16. In the preferred embodiment a 420 high carbon stainless steel of surgical instrument grade is utilized so as to provide a rust resistant tool which provides the necessary structural strength for application of high amounts of torque. As shown in FIG. 2 body 12 of tool 10 is relatively thin in comparison to its length and in this manner assists in the manipulation of the tool in tight areas. The thin size also allows for greater comfort when carried. In the preferred embodiment the thickness is approximately ⅛ inch while the length is approximately 4 inches and the width of the body is approximately 1 inch.

Still referring to FIG. 1 an end 20 of the tool opposite opening 18 is bevelled to provide an implement which may be utilized as a screw driver or a wedge or a pry bar or other similar instrument. Bevelled end 20 (FIG. 2) may be seen to be a constant angle without concavity. However, when bevelled end 20 is examined on end as in FIG. 3 it may be observed that a variety of thicknesses of the bevelled edge are provided. This is due to the thickness of the body 12 and the bevelling of a single side of body 12. This construction produces a thin bevelled end tip 22 which increasingly thickens as the bevelled end creases until the entire thickness of the body 12 is achieved at area 24. This manner of construction allows the user to select a thickness of the bevelled end 20 which is the proper thickness for engagement with the slot 27 (FIG. 7) of a slotted screw or bolt 29 (FIG. 7). As a result of this construction bevelled end 20 acts as a wide variety of sizes of straight edge screw drivers. A user may simply rotate the body 12 of the device through the radius of the curved edge 26 (FIG. 1) of bevelled end 20 to present an edge of the proper width so as to fill the available slot 27 (FIG. 7) in the head of the screw or bolt 29 (FIG. 7).

Referring now to FIG. 2 it may be observed that bevelled end 20 is bevelled on only one side of body 12 of the tool. This is in contravention to a standard screw driver which is bevelled on both sides. The single sided bevel is constructed to provide greater strength to the bevelled end 20 thus enhancing it use as a pry bar or wedge. In this manner of construction both the screw driver utility and the pry bar utility are maximized without unnecessarily sacrificing strength of the tool.

Referring again to FIG. 1 the hexagonal opening 30 is shown. While this hexagonal opening could be of any size or could be square shaped or a combination of hexagonal and square shaped it is, in the preferred embodiment, sized to accommodate a quarter inch hexagonal socket or other tool of hexagonal shape. As shown in FIG. 6, when a socket 37 is inserted into opening 30 the combination tool 10 becomes the handle for socket 37 allowing application of torque to socket 37 and to fastener 36 grasped therein.

DESCRIPTION OF WRENCH OPENING

The wrench opening 18 is designed so as to combine the advantages of an adjustable plier or adjustable jaw type wrench with those of a fixed jar or box type wrench. In order to more clearly state and help in understanding of how this is true, I have listed specific design perimeters employed to develop the wrench opening 18 of the preferred embodiment.

a. Must have no moving parts to break or wear out.
b. Must be able to grip any size hexagonal or square fastener within its grip range.
c. Must have a wide grip range or ratio between largest and smallest fastener than can be gripped. (The preferred embodiment ratio is 3.7 to 1; however, the design does not limit it to this ratio.)
d. Must be able to apply full wrist force torque to fasteners (approximatley 25 ft. lbs.) without damaging itself in any way.
e. Must be as compact and lightweight as possible.
f. Must be able to reasonably reach and grip fasteners in close proximity to flanges and adjacent obstructions.
g. Must be able to grip fasteners which may have some degree of rounding off of their angled corners 54 as can normally occur on fasteners that are frequently tightened and loosened.
h. Must be able to provide a ratcheting the like gripping action on hexagonal fasteners. This must occur without pulling away or removing the wrench from capture of the fastener. The grip must reoccur at minimum with every 60° of counter torquing rotation.
i. Must be a practical design readily suited to efficient manufacturing methods.

Referring now to FIG. 1 in conjunction with FIGS. 4, 5 and 8, the wrench opening 18 will now be described in detail.

As may be observed in FIG. 1, the opening is generally an elongated tear drop shape with straight sidewalls 14, 16 converging toward the one another at a narrow end 40 of the opening and diverging from one another at the opposite wide end 42. The diverging or wide end 42 of opening 18 may be viewed as simply connective material of body 12 of tool 10 which is used to strengthen sidewalls 14, 16 of opening 18 to enable the application of high amounts of torque without bending occurring in sidewalls 14, 16.

In FIG. 8, the wrench opening geometry is shown in great detail. The geometric relationships shown are critical to the function and utility of the wrench opening. There are two paramount factors which must be defined in order to obtain the intended function. The first factor affecting the wrench opening geometry is the spacing between teeth or tooth pitch D2 and the rate at which the teeth decrease in size and spacing toward the narrow end 40. The rate of tooth pitch reduction or increase is a ratio of the tooth pitch D2 and D1, D1 being the distance of any given tooth from the geometric vertex of sidewalls 14, 16. The geometric vertex of sidewalls 14, 16 is indicated as V, which is shown to be the intersection of two dashed reference lines ff and gg. Reference lines ff and gg are superimposed upon and extended beyond sidewalls 14, 16 respectively.

Referring to FIG. 8, the ratio of any tooth's distance from the vertex of the sidewalls D1 compared to the pitch D2 of the same tooth is 12/1. This ratio of D1/D2 is a constant that is true for any tooth in the wrench opening 18. This particle ratio of 12 to 1 is considered to be near optimum. It was arrived at through geometric analysis and physical testing of numerous higher and lower ratios. I have determined that ratios of D1 to D2 which are lower than 9 to 1 or higher than 24 to 1 would of little value as a practical wrench device on hexagonal fasteners. It may be noted that in the above described ratio range, a ratio of 12 to 1 is not a center range but a relatively low ratio. The relatively low 12 to 1 tooth pitch ratio is the result of compromising to other limiting factors, i.e., manufacturing limits on tooth size, and the need to have as large a tooth as is practical in order to effectively grip and apply torque to fasteners.

Continuing in reference to FIG. 8, the second primary factor affecting the wrench opening 18 geometry is the angle L1 between sidewalls 14 and 16. In the preferred embodiment, angle L1 is established at 30°. This preferred angle of 30° for L1 was again arrived at after thorough geometric analysis and physical testing of various other angles, both larger and smaller. The chosen angle of 30° for L1 is believed to be close to optimum for the intended purpose of the wrench opening 18. It will be found that increasing angle L1 will tend to reduce the grip area G1 and G2 available to catch the angled corner 54 of a fastener. A reduced grip area G1, G2 reduces the ability of the teeth to efficiently obtain and maintain a grip on fasteners. Conversely, it will be found that reducing angle L1 below 30° also tends to have a negative effect on function. Reduction of L1 results in a lengthening of the wrench opening 18. The longer the wrench opening 18 becomes, the more difficult it will be to reach and grip smaller fasteners near end 40. This negative effect is compounded by greater stresses placed on the sidewalls 14, 16 as a result of of their greater span. It has been determined that L1 should be held between 25° to 35° in order to maintain the desirable functional characteristics.

Referring again to FIG. 8, it will be noticed that the tooth projections 32, 34 are essentially pointed and appear very much as saw teeth appear with the exception of a generous full inside radius 66 in their inside corner. This radius 66 is an important component of the tooth form and is helpful in reducing stresses in the tooth projections 32, 34 when they are under pressure from acting on fasteners.

Another noteworthy aspect of the tooth design is the ability of the tooth projections 32, 34 to function well, even after the points of the teeth 32, 34 have become slightly rounded through normal use. This condition is to be expected with the normal wear and tear of use of any wrench type tool. It has been found, however, that slight rounding of the tooth points has no outward negative effect on the function or the torque applying ability of the wrench opening 18. Some minor radiusing of the tooth points may also occur to a slight degree in the finishing operations attendant to manufacturing of the tool.

It should be noted now that the mechanics of how the wrench opening 18 operates are that the fasteners which are acted upon are not gripped by virtue of a biting action imparted to fasteners by the tooth projections 32, 34 on sidewall 16, but that the fasteners are captured by virtue of the geometry of the opposed sidewalls 14, 16 and the tooth projections 32, 34 thereupon.

These and other factors affecting the chosen geometry and design of the wrench opening 18 will become more evident as the method of operation is explained.

WRENCH OPENING OPERATION

In FIGS. 4 and 5 the wrench opening 18 is shown in use. Opening 18 is adapted to be utilized with both hexagonal and square shaped nuts and bolts as well as numerous other regular and irregular shaped fasteners. This is accomplished through the use of the converging sidewalls 14, 16 of opening 18 which accommodate fasteners of minimum size near end 40, the narrow end of opening 18, and fasteners of maximum size near end 42, the wide end of opening 18. Thus with movement of body 12 of tool 10 along a line parallel with the longitudinal axis of tool 10, sidewalls 14, 16 of opening 18 may be secured against objects of any shape which can be received within the opening 18.

In applying torque to faceted fasteners such as a hex or square or any other shape of fastener presenting corners and faces the tooth projections 32, 34 protruding from sidewall 16 are utilized in conjunction with sidewall 14 to provide a secure grasp of the fastener. This is accomplished by placing the fastener within opening 18 proximate to end 42 whereupon the body 12 of tool 10 is pushed in a direction parallel with the longitudinal axis of the tool so as to direct the narrow end 40 of opening 18 toward the fastener. During this motion the fastener will engage and disengage with the variously sized tooth projections 32, 34 until the sidewalls 14, 16 are in close contact with the fastener.

This is illustrated in FIG. 4, 5 and 8 wherein fasteners of diverging sizes are illustrated being captured between sidewalls 14, 16. As shown in FIGS. 4 and 5 the flat face 52, 53 of a fastener 50, 51 is pressed against the surface of sidewall 14. An angled corner 54, 55 of fastener 50, 51 generally opposite the smooth of flat face 52, 53 of fastener 50, 51 which is against sidewall 14, is then captured within one of the depressions 62, 64 between tooth porjections 32, 34. Thus as torque is applied to body 12 the tooth projections 32, 34 and depression 62, 64 on sidewall 16 engage the angled corner of the fastener and torque is transmitted to the fastener.

In FIG. 8, two positions of the large hexagonal fastener 50 are shown as P1 and P2, P2 is drawn into phantom lines. These two positions, P1 and P2, show the optimum and minimum gripping positions that will occur on a hexagonal fastener 50 within the wrench opening 18 in the preferred embodiment. P1 shows a hexagonal fastener 50 in the optimum position just captured by the smallest tooth projection available to grip it. P2 shows a hexagonal fastener 50 rotated to angle L2 against sidewall 14 to where it is captured by the next larger tooth available on sidewall 16. This relationship of tooth size and position is repeated geometrically on any size hexagonal fastener that can be captured within the wrench opening 18. This is due to the fact, as previously mentioned, that the tooth projections and the space between them are reducing or increasing in size in direct proportion to changes in fastener size.

Angle L2 is the maximum angle of deflection that a hexagonal fastener 50 can achieve between its flat side 52 and sidewall 14 before it is captured by its angled corner 54 in one of the tooth projections on sidewall 16. Angle L2, which is 12° in the preferred embodiment, is a critical angle to the planned geometry of wrench opening 18. It is desirable to keep the deflected angle L2 as small as possible; however, in order to capture and effectively grip and torque hexagonal fasteners of any size, it is necessary to have some degree of deflection between the smooth face 52 and the smooth sidewall 14. Increases in angle L2 tend to permit greater slippage of the flat face 52 of fastener 50 against the smooth sidewall 14. This slippage does not contribute greatly to the torque applying capabilities of the wrench opening but rather can result in damage to the fastener itself and additionally increases the stresses applied to sidewalls 14 and 16 by the fastener 50 as it is being turned, which is not desirable.

Another feature of the present invention will be explained in reference to FIG. 8. In the preferred embodiment, tooth projections 32, 34 are present on only one of the sidewalls 14. This permits the wrench opening to apply a ratcheting type action when operated on hexagonal and other faceted fasteners. This simply accomplished by applying counter rotation to body 12 as it is held against the fastener. The counter rotation is opposite to the rotation that enables tooth projections 32, 34 to engage the fastener 50. The counter rotation is continued until the tooth projections 32, 34 arrive at another angled corner of the fastener 50. At this point, body 12 can again be rotated in a torque applying direction to re-engage and regrip the fastner. This action can be accomplished without removing or pulling away of body 12 from the fastener. This characteristic of the present invention is unique from the prior art in that previous designs have not had a wrench opening 18 with tooth projection geometry that provided identical gripping and ratcheting characteristics on all size fasteners within the opening's range. It will be found with toothed wrenches that have teeth of constant pitch, that on many fasteners the ability to ratchet is inhibited by a tendency to catch or snag the fastener when counter-rotated, which results in a need to pull back away or remove the wrench from the fastener in order to obtain a new grip position. Additionally, it will be found in prior art, where toothed wrenches had very shallow angles between opposite sidewalls, it would be very difficult to obtain a ratcheting action unless the fastener had very short facets or no facets at all. In this case, irregardless of tooth projection geometry, the angle between sidewalls would ultimately be the defeating factor. I believe that it can now been seen that the wrench opening of the preferred embodiment does achieve the specific design perimeters previously listed.

I believe it can also now be seen that the described wrench opening employed in conjunction with the beveled end of the tool, which provides the screwdriver/prybar feature and the hex hole that allows it to operate inserted sockets, does comprise a unique and extremely utilitarian tool. A tool which could easily be carried and utilized by someone of any age or in any occupation in these modern times.

Although the description above contains many specificities, these should not be construed as limiting the scope of the invention, but as merely providing illustration of some of the presently preferred embodiments of this invention. It has been considered that other possible tools could be incorporated into the body 12 of this tool, such as a can opener aperture, imprinting of rulers on the faces of the body 12 and a golf cleat wrench could be incorporated into the body 12 of the tool. The wrench opening 18 itself could also be easily incorporated into other implements such as the handle or blade of a knife or even configured into a fold-out wrench utilized in a pocket knife type device, as well as many other ramifications, too numerous to list.

Thus, the scope of the invention should be determined by the appended claims and their legal equivalents rather than by the examples given.

It is to be understood that while certain forms of this invention have been illustrated and described, it is not limited thereof, except in so far as such limitations are included in the following claims.

What is claimed and desired to be secured by Letters Patent is as follows:

1. A tool comprising:

a bar adapted to be grasped in the hand of a user, and having a hole with two generally straight sidewalls diverging near one end of the bar for receiving a faceted workpiece, a plurality of tooth like projections on one sidewall of said hole the other sidewall being smooth, wherein the size and sizing of said projections progressively decrease as the position of said projections relative to said sidewall approaches the convergence of said sidewalls, such that torque may be applied by the user to a faceted workpiece by capture of a single facet point of said workpiece between two of the said projections and the opposite sidewall of said hole, and each projection being joined by an arcuate surface.

2. The tool as claimed in claim 1, further comprising a beveled edge at an end of said bar to permit insertion of said beveled edge into a slotted opening for application of force thereto.

3. The tool as claimed in claim 1, further comprising a hexagonal aperture in said bar adapted to receive a hexagonal tool shank therein.

4. The tool as claimed in claim 1, further comprising said one end of said bar being a closed end.

5. A tool claimed in claim 4, further comprising a beveled edge at an end of said bar to permit insertion of said beveled edge into a slotted opening for application of force thereto.

* * * * *